United States Patent [19]

Murray

[11] Patent Number: 4,562,657

[45] Date of Patent: Jan. 7, 1986

[54] DISPLAY STRUCTURE

[75] Inventor: Ledell L. Murray, Noblesville, Ind.

[73] Assignee: General Indicator Corporation, Pardeeville, Wis.

[21] Appl. No.: 610,964

[22] Filed: May 16, 1984

[51] Int. Cl.[4] ..... G09F 11/18

[52] U.S. Cl. ..... 40/518; 40/10 R

[58] Field of Search ..... 40/518, 547, 563, 10 R

[56] References Cited

U.S. PATENT DOCUMENTS

| | | | |
|---|---|---|---|
| 1,708,479 | 4/1929 | MacDonald | 40/518 |
| 1,896,935 | 2/1933 | Bloomfield et al. | 40/518 |
| 3,076,277 | 2/1963 | Maze | 40/563 |
| 3,159,937 | 12/1964 | Barnes | 40/518 |
| 3,939,584 | 2/1976 | Trame | 40/518 |
| 4,216,599 | 8/1980 | Eckert | 40/576 |
| 4,337,588 | 7/1982 | Clapper | 40/518 |
| 4,375,730 | 3/1983 | Sanders et al. | 40/518 |

*Primary Examiner*—Gene Mancene
*Assistant Examiner*—Cary E. Stone
*Attorney, Agent, or Firm*—Bayard H. Michael

[57] ABSTRACT

The price display module has a clear plastic light transmission and support member or light pipe on the back of a bezel to display an indicia on the pre-coiled strip through the bezel aperture and illuminated by light reflected through the member or light pipe from behind the bezel to the front of the member. The coiled ends of the strip are supported by and separated by the support member so the illumination of the displayed indicia is uniform. The support member is held in place on the rear of the bezel by retainers slideably guided on the bezel and having a tab which slides over and engages a shelf or flat surface at each end of the support member.

4 Claims, 4 Drawing Figures

DISPLAY STRUCTURE

BACKGROUND OF THE INVENTION

Fast food stores typically display the names of food items and prices on signs which are provided with back lighting. The prices are displayed on modules permitting changing the price. Typically, the numbers are on pre-coiled price strips which are supported so that when one of the numbers is displayed at an aperture in a bezel, each end of the strip is coiled. These coils tend to close behind the displayed number and cast shadows on the number. The lighting is not uniform and the displayed numbers are darker than desirable.

My co-pending application Ser. No. 423,692 filed Sept. 27, 1982 shows a solid light pipe arrangement which keeps the coil apart while piping light to the front for emission through the displayed number.

My co-pending application Ser. No. 552,295 filed Nov. 16, 1983 shows an open channel-like member instead of the solid light pipe. The legs of the channel converge and then diverge going from the rear to the front. This forms troughs on the outside of the member receiving the coiled ends of the price strip. The angles of convergence and divergence are selected to optimize light reflection so the inner surfaces of the legs reflect light much like the interior surface of the solid light pipe. Thus, the open member functions like a light pipe and could be called an open light pipe.

Mounting a solid light pipe or the channel type on the back of the bezel was not satisfactory. The retention means could be broken and considerable force was required to mount and remove the channel.

SUMMARY OF THE INVENTION

The principal object of this invention is to provide an improved mounting arrangement for fixing a light reflecting and support member (i.e., a solid or open light pipe) on the rear of a bezel. A further feature is to positively locate the support member on the bezel by having ribs engage grooves and by having the face(s) of the support member project into the apertures in the bezel.

Finally, a very important feature is to provide slideable retainers guided on the rear of the bezel to positively engage the support member while being movable to release the member for service.

DETAILED DESCRIPTION OF THE DRAWINGS

Figure 1:
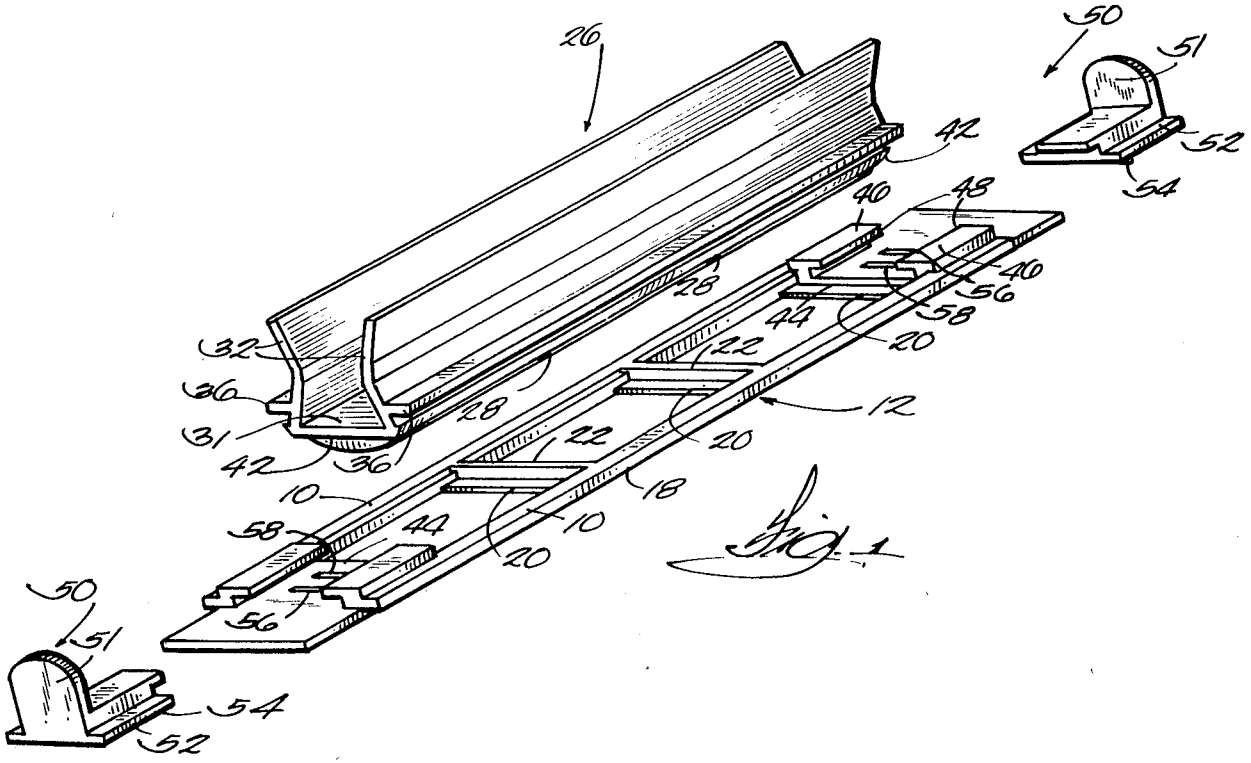
FIG. 1 is an exploded perspective view of an open light pipe and bezel with the retainers moved endwise.
Figure 2:
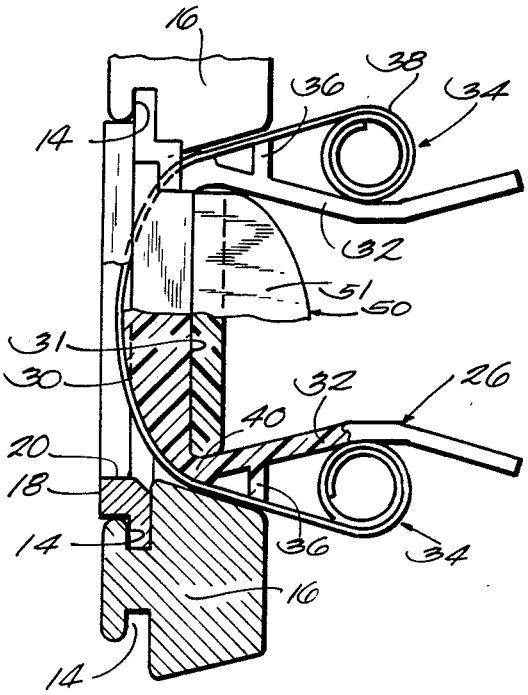
FIG. 2 is a vertical action with parts broken away to show the relationship of the retainers, pipe and bezel.
Figure 3:
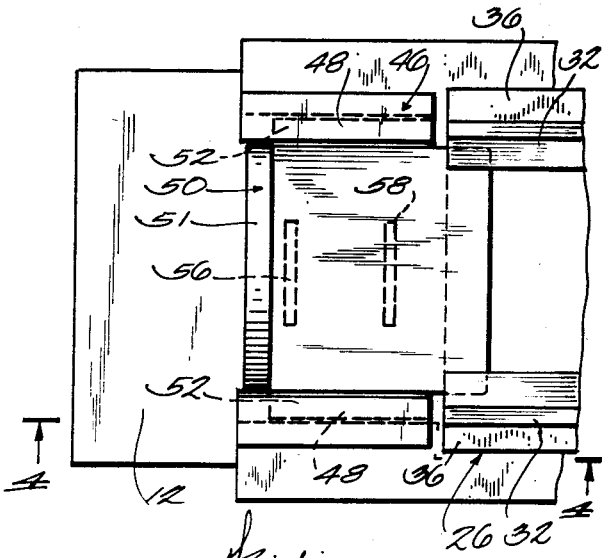
FIG. 3 is a plan view showing the end of a pipe retained in the bezel by a retainer tab.
Figure 4:
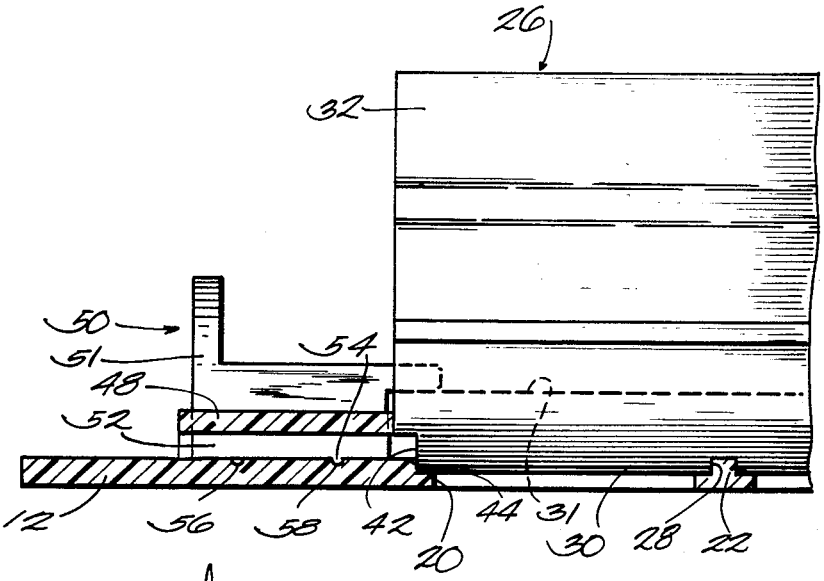
FIG. 4 is a section on line 4—4 in FIG. 3.

The sides 10, 10 of the bezel 12 fit into the grooves 14 of rails 16 fixed in the frame (not shown) to support the bezel with the front 18 between and flush with the fronts of the rails 16. The bezel has three apertures 20 separated by dividers 22. Light transmitting member 26 has slots 28 in the front surface of the member 26 fitting over dividers 22 with the front surface 30 of the support member 26 in registry with each of the bezel apertures 20.

The support member 26 is generally channel-like with the legs 32, 32 extending to the rear of the module and slightly kinked in towards each other so that they converge and then diverge going from the rear towards the front surface. The angle of convergence and divergence is selected to insure that light entering the open rear end of the support member will be reflected within the space between the legs rather than passing out through the legs. The light comes from fluorescent tubes about 6" behind the module and may be regarded as traveling in a horizontal path. The optimum angle of convergence/divergence under such conditions is 22 ½°. This is the most efficient reflection angle off a polished surface. Greater or lesser angles are not as efficient. Indeed, if the angle of incidence is high the light passes through the plastic. Therefore, when the direct or reflected light finally reaches the front of the support member 26, it strikes the flat back 31 of the front surface 30 at a high angle of incidence and passes through the front surface to illuminate the pre-coiled price strip 34. The coiled ends of the strip are supported in the "troughs" behind the shelves 36 which prevent the coiled ends 38 from getting into and jamming in the converging space between the legs 32 and the beveled rails 16.

The gap between the ends of the shelves 36 and the beveled rails and the gap between the guides 40 and the rails is selected to ensure the curl of the price strip will cause the strip to frictionally engage the rails and resist the tendency to move when the frame is vibrated.

The channel-like support 26 must be easily mounted on and removed from the bezel 12. The support is fabricated from an extruded piece. The curved front surface 30 is cut at two places to provide grooves 28 which fit over the dividers 22 on the rear of bezel between the windows. Each end of the support 26 is undercut at 42 to provide a flat shelf to overlie the surface 44 on the back of the bezel between the end window and the end of the bezel. Each end of the bezel is provided with opposed guides 46 having edges 48 projecting inwardly to confine the associated retainer 50 to linear motion with each edge 52 of the retainer captured between the overlying guide edge 48 and bezel surface 44. The surface of the retainer facing the bezel has a rib 54 engageable with either of the grooves 56, 58. When the rib engages groove 58, the tab 60 projecting from the retainer will overlie the flat shelf or surface 31 of the support to hold the support in position on the rear of the bezel. When the retainer is moved aside laterally, the rib 54 will engage groove 56 to hold the tab 60 in its inactive position permitting easy removal of the support. The rib and grooves detent the action and with close tolerances can function to fix the retainer in either position and resist accidental movement. The retainer is provided with an upstanding finger hold 51 to facilitate actuation.

The support member functions like a solid light pipe. The solid light pipe has fewer surfaces to keep clean but costs more. The open light pipe can be used to retrofit certain structures to give them the advantage of the light pipe uniform lighting. If the support member takes the form of a solid light pipe, it would preferably have a similar exterior shape having the opposed grooves receiving the coiled ends of the price strip. The ends of each light pipe can be cut or formed to permit mounting by means of the retainers 50. Both the solid light pipe and the open pipe or channel support function to separate and support the coiled ends of the price strip while reflecting light between the coiled ends and subsequently spreading the light over the displayed numeral.

I claim:

1. A display module including, a horizontally disposed opaque bezel having an aperture therein and having a front and a rear, a horizontally disposed clear plastic light reflecting and support member having a curved front face projecting into said aperture in said bezel and having a rear portion lying behind said bezel, said member having a light transmission axis normal to the plane of the bezel and including reflective surfaces reflecting light entering the member from behind forwardly for emission through said front face of the member, said member having on each horizontal end a shelf overlying said bezel, guide means on the rear of said bezel adjacent said aperture close to each said horizontal end of said member, a retainer slideably mounted in each said guide means for linear movement between an active position engaging and overlying the adjacent shelf and an inactive position disengaged from said adjacent shelf, a pre-coiled indicia strip having coiled ends, said strip being mounted in the module with a portion thereof across said curved front face of said member to be illuminated by the light emitted through said front face and with the coiled ends of the strip separated and supported by the outside of the member while light is transmitted between said coiled ends, said bezel has a plurality of apertures therein, said bezel including dividers between said apertures, said light reflecting and support member being a single piece provided with transverse grooves fitting over said dividers to locate the member relative to said bezel, detent means acting between said retainer and said bezel to hold said retainer in said active position.

2. A display module including, a horizontally disposed opaque bezel having an aperture therein and having a front and a rear, a horizontally disposed clear plastic light reflecting and support member having a curved front face projecting into said aperture in said bezel and having a rear portion lying behind said bezel, said member having a light transmission axis normal to the plane of the bezel and including reflective surface reflecting light entering the member from behind forwardly for emission through said front face of the member, said member having on each horizontal end a shelf overlying said bezel, guide means on the rear of said bezel adjacent said aperture close to each said horizontal end of said member, a retainer slideably mounted in each said guide means for linear movement between an active position engaging and overlying the adjacent shelf and an inactive position disengaged from said adjacent shelf, a pre-coiled indicia strip having coiled ends, said strip being mounted in the module with a portion thereof across said curved front face of said member to be illuminated by the light emitted through said front face and with the coiled ends of the strip separated and supported by the outside of the member while light is transmitted between said coiled ends, said support member having a generally U-shaped cross-section formed so the spaced and opposed parts of the U converge and then diverge going from said rear to said front face of the member, and the confronting surfaces of said parts of said support member act to reflect light entering the space between said parts from the rear towards and through the front of the member, the converging/diverging configuration of said parts forming a shallow trough on the outside of each said part, said shallow troughs serving to keep the coiled ends of said strip separated while light is transmitted between said coiled ends.

3. A display module including, an opaque bezel having a horizontal aperture therein, a clear plastic light reflecting and support member having a light transmission axis normal to the plane of the bezel, said member having a front and a rear and being horizontally disposed in said aperture with its horizontal ends adjacent the horizontal ends of said aperture, said member including reflective surfaces reflecting light entering the rear of the member from behind forwardly to and through the front of the member, means locating said member on the rear of the bezel in registry with said aperture, guide means mounted on said bezel in the proximity of each end of said member, a retainer slideably mounted in each of said guide means for linear movement between an inactive position and an active position engaging said support member, a pre-coiled indicia strip mounted in the module with a portion of the strip extending across the front surface of said member to be illuminated by light transmitted through said front, the opposed sides of said member being between said front and said rear and formed to converge and diverge going from the rear to the front of the member whereby a shallow trough is formed in each of said sides.

4. A display module according to claim 3 in which the ends of said strip on either side of said portion being coiled by reason of said strip being precoiled, the coiled ends of said strip being received in said troughs while said support reflects and transmits light between said coiled ends.

* * * * *